United States Patent [19]

Bovey et al.

[11] 3,930,845

[45] Jan. 6, 1976

[54] PRODUCING HIGH PURITY GOLD POWDER

[75] Inventors: Herbert J. Bovey, Krugersdorp; Dennis A. Temple; Basil J. Goldswain, both of Johannesburg, all of South Africa

[73] Assignee: Anglo American Corporation of South Africa, Johannesburg, South Africa

[22] Filed: Jan. 22, 1973

[21] Appl. No.: 325,307

[30] Foreign Application Priority Data

Jan. 21, 1972 South Africa ..... 72/0446

[52] U.S. Cl. ..... 75/108; 75/112; 75/118

[51] Int. Cl.[2] ..... C22B 3/00

[58] Field of Search ..... 423/38, 40, 42; 75/109, 75/111, 112, 114, 118, .5 A, .5 R, 108

[56] References Cited

UNITED STATES PATENTS

| | | | |
|---|---|---|---|
| 267,723 | 11/1882 | Schaeffer | 75/118 |
| 1,671,004 | 5/1928 | Bagsar | 75/109 |
| 3,709,681 | 1/1973 | Wilson | 75/114 |
| 3,778,252 | 12/1973 | Wilson | 75/109 |

OTHER PUBLICATIONS

Rose — *The Metallurgy of Gold* – 1894 – p. 10.

Bureau of Mines — Report of Investigations 6486 – 1964 – pp. 17–19.

Chemical Engineering Mag. — New Data on Metal – Complex Formation – 11/27/61.

*Primary Examiner*—Oscar R. Vertiz
*Assistant Examiner*—Eugene T. Wheelock
*Attorney, Agent, or Firm*—Young & Thompson

[57] ABSTRACT

Merrill slime is contacted with a gold chloride solution to cement out gold and dissolve base metals. The separated solids are treated in a known type of process by chlorination with elemental chlorine, separation of the chlorinated solution and precipitation of gold powder by means of a reductant. The precipitation is partial and the remaining solution is used for the cementation step. The gold powder is separated and subjected to special washing techniques for the removal of adsorbed impurities. A molar ratio of Cl/Au of about 4 after chlorination is aimed at to minimise the solubility of silver chloride. After removing solid impurities this ratio is raised to ensure that any dissolved silver remains in solution when gold is subsequently precipitated.

5 Claims, 1 Drawing Figure

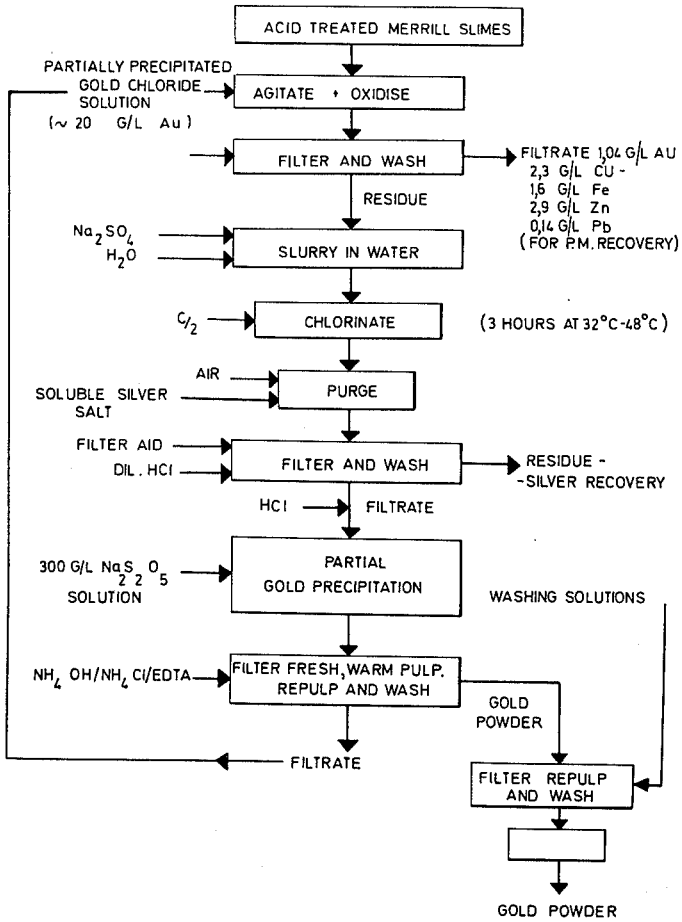

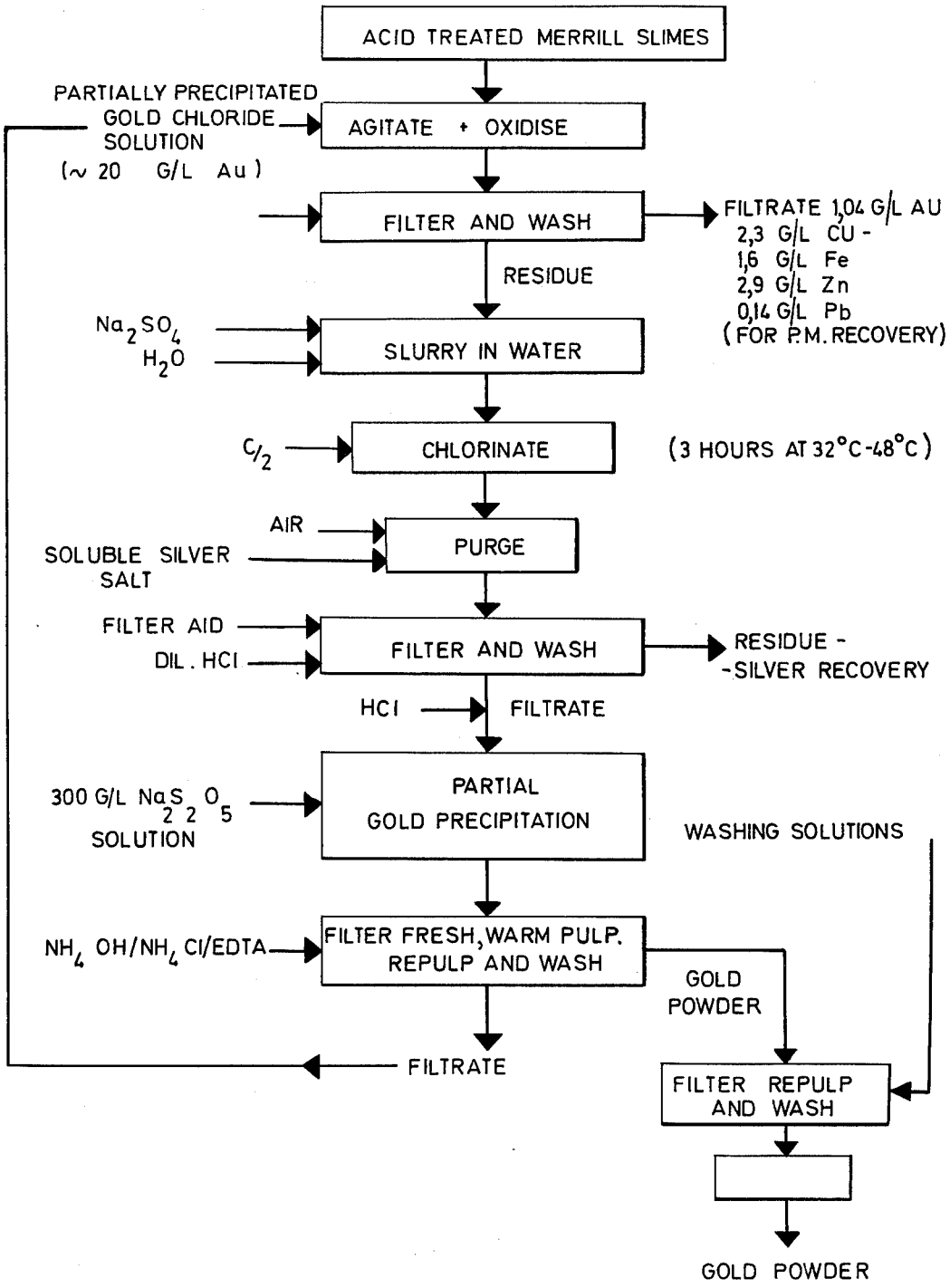
ACID TREATED MERRILL SLIMES
PARTIALLY PRECIPITATED GOLD CHLORIDE SOLUTION (~ 20 G/L Au)
AGITATE + OXIDISE
FILTER AND WASH
FILTRATE 1,04 G/L AU
2,3 G/L CU -
1,6 G/L Fe
2,9 G/L Zn
0,14 G/L Pb
(FOR P.M. RECOVERY)
RESIDUE
$Na_2SO_4$
$H_2O$
SLURRY IN WATER
$C/_2$
CHLORINATE
(3 HOURS AT 32°C-48°C)
AIR
SOLUBLE SILVER SALT
PURGE
FILTER AID
DIL. HCl
FILTER AND WASH
RESIDUE - -SILVER RECOVERY
HCl
FILTRATE
300 G/L $Na_2S_2O_5$ SOLUTION
PARTIAL GOLD PRECIPITATION
WASHING SOLUTIONS
$NH_4OH/NH_4Cl$/EDTA
FILTER FRESH, WARM PULP. REPULP AND WASH
GOLD POWDER
FILTRATE
FILTER REPULP AND WASH
GOLD POWDER

PRODUCING HIGH PURITY GOLD POWDER

This invention relates to the production of high purity gold powder.

Conventionally, on South African gold mines a crude gold bullion, assaying circa 80–90% gold, is produced from Merrill slime (the product of adding zinc dust to gold-containing cyanide solution thereby to produce a replacement precipitate of gold on excess zinc) by a sequence of operations starting with acid digestion of the slimes to dissolve base metals, e.g. copper, zinc, etc. This is followed by smelting of the resultant acid insoluble product under a flux cover to yield the abovementioned gold bullion product.

The crude bullion is sent to a central treatment depot where, by a process involving chlorination of the molten metal to eliminate silver and residual base metal impurities, it is refined to a product having an assay of about 99.6% Au. By electrolysis of the refined gold product, it is possible to produce solid gold cathodes assaying as high as 99.99% Au.

In another process, the Merrill slime may be directly chlorinated in aqueous suspension, either before or after the above-mentioned acid treatment. The gold and associated base metal contents are thereby largely converted to soluble chlorides while silver is largely present as insoluble silver chloride. From the gold chloride solution remaining after separation of the silver chloride and chlorination residue, gold metal powder may be precipitated by addition of a reductant which may be sulphur dioxide, sodium bisulphite or hydrosulphite, oxalic acid or ferrous sulphate, to name but a few of the common reductants. As precipitated, the powder gold may contain traces of inpurities, e.g. Ag, Cu, Fe, Zn, Pb which cannot be entirely removed by simple washing techniques.

Therefore, in order to obtain gold approaching "four nines" purity, the powder requires to be melted under a flux cover, whereby the impurities are caused to dissolve in the flux, leaving the purified gold now in lump form, rather than powder.

An object of the invention is to produce gold in powder form to a purity at least approaching 99.99% Au.

According to the invention a process for treating gold bearing material, such as Merrill slime, consists in the steps of:

- contacting the material with a gold chloride solution by agitation, whereby dissolved gold is caused to be cemented out on the material while base metal impurities go into solution;
- separating the cemented material from the solution;
- suspending the cemented material in water and chlorinating the suspension by passing chlorine gas through it;
- separating the residual solution from the solids;
- precipitating gold powder from the residual solution by the addition of a suitable reductant; and
- separating, washing and drying the precipitated gold powder.

Further according to the invention during the chlorination process less than a stoichiometric amount of reductant is used, so that a proportion of the gold remains in solution and this solution, after separation of solids, is used for mixing with the Merrill slime pulp.

The invention is further discussed with reference to the accompanying drawing which is a flow sheet illustrating the production of high purity gold powder.

Acid treated Merrill slime containing 50.00% Au (dry basis) is suspended in water. Sodium sulphate may be added to ensure the presence of sufficient sulphate in the next stage of the process to react with all the lead present in the slime. This resultant pulp, is agitated with a gold chloride-containing solution from a later operation by agitating with air for about 6 hours at 60°. A reaction takes place in which the gold in solution is caused to be cemented out on the Merrill slime, resulting in the oxidation of an equivalent amount of contained base metals from the slime to their chlorides, with the dissolution of these metals such as zinc, copper and iron. Thus, the Merrill slime is upgraded in gold content and reduced in base metal content, which is an important aspect of the later processing steps which allow production of high purity gold powder.

The cemented Merrill slime is filtered and washed, the filtrate, substantially free of gold but containing base metal chlorides, being discarded after removing traces of gold. The cemented slime is then suspended in water containing sodium sulphate (in an amount at least equivalent to lead contained in the slime) and chlorinated by passing chlorine gas through the pulp to convert the contained gold to soluble chloride form. Usually, this chlorination will take of the order of 2–3 hours and chlorination is generally discontinued when the pulp ceases to demand chlorine.

The chlorinated pulp is purged with air to displace excess dissolved chlorine and to cool the pulp at least to ambient temperature. The cooling causes dissolved silver to precipitate and to be removed in the filter cake. The pulp is then filtered and washed after the addition of a siliceous filter aid.

Acidified wash solutions are preferred to ensure maximum recovery of dissolved gold and hydrochloric acid is the preferred acid. If relatively concentrated hydrochloric acid solution (e.g. normal) is used the washings must be kept separate from the filtrate since they will contain excessive amounts of dissolved silver chloride. Such a solution could be combined with the gold-containing solution used to react with the slime initially. Alternatively, a more dilute hydrochloric acid (e.g. 0.05 N) could be used for washing and the washings could then be mixed with the filtrate since the solubility of silver chloride is much lower in such solutions.

For the most efficient silver separation from the gold bearing filtrate the molar ratio of Cl/Au in the filtrate should be about 4 which gives a minimum solubility of silver chloride. For any adjustment of chloride concentration to be effective there must be an adequate period of equilibration before filtering off the chlorination residue. Upward adjustment of chloride concentration presents no problem but downward adjustment requires the addition of a soluble silver salt such as the sulphate or nitrate. In some cases it may be desirable to make such additions of silver salt after separating the chlorination residue. This would necessitate an extra filtration step but would permit the addition of sulphate to the chlorination slurry to be eliminated. Instead a relatively small addition of sulphate is made with the silver salt supplying part of the sulphate (if silver sulphate is used). Such a procedure permits the amount of silver salt added to be reduced since no chloride is liberated from the precipitation of lead sulphate.

The filtrate at the Cl/Au molar ratio of about 4 is next treated with hydrochloric acid to raise this molar ratio; an increase in chloride concentration of 0.2 M should be adequate. This increases the solubility of any remaining dissolved silver and stabilizes the solution.

The residue which has been filtered off and which contains both precipitated and undissolved silver and traces of gold is treated for the recovery of the precious metals.

The stabilized filtrate, which is now a purified gold chloride solution, is next treated with a reductant such as sodium metabisulphite added as a solution in an amount sufficient to precipitate about 80% of the contained gold. This treatment generally takes about 15 minutes. The precipitated gold powder is filtered off as soon as possible from the still warm solution.

Less than the stoichiometrical gold equivalent of the added reagent is precipitated and the quantity of reductant used must be such that the amount of gold left in solution at the end of the reaction is just sufficient to oxidise the impurity metals in the next charge of Merrill slime to their chlorides. This enables the reaction cycle to be closed.

The powder is subjected to a series of washes. The first is with ammonia-ammonium chloride solution containing ethylene diamine tetra acetic acid, then with dilute hydrochloric acid, followed by water. This combination serves to remove metal ions such as iron and silver which are absorbed on the gold powder. Next the gold powder may be washed with alcohol and finally with acetone to displace water.

Finally the gold powder is dried. At a drying temperature of 110°C gold powder assaying in excess of 99.95% Au was produced. The powder consisted of aggregates of 1–2 microns. Drying at higher temperatures can result in a higher gold assay.

EXAMPLE 250 g of acid treated Merrill slimes assaying 30.1% Au (wet basis) were agitated at 50°C with 2020 ml of gold chloride solution from a previous run, analysing 20.23 g/l Au.

After 6 hours agitation, the slurry was filtered and washed, resulting in 2030 ml of solution being obtained analysing 1.04 g/l Au, 2.3 g/l Cu, 2.9 g/l Zn, 1.6 g/l Fe, 0.01 g/l Ag, 0.14 g/l Pb. This solution was treated to recover the small amount of contained gold. The filtered residue was suspended in 1 litre water, 352 g sodium sulphate decahydrate added to convert soluble Pb salts to a less soluble sulphate form and the solution chlorinated in a closed propeller stirred glass vessel by passing in chlorine gas through a glass tube. The chlorine rate was such as to maintain approximately atmospheric pressure in the chlorination vessel. During chlorination the temperature rose to 48°C. After 3 hours chlorination, by which time the temperature had fallen to 32°C and chlorine demand was negligible, passage of chlorine was stopped. Air was passed into the pulp for 60 minutes to cool and purge chlorine. To the resultant pulp was added 50 g of diatomaceous earth filter aid and the slurry, after briefly stirring, filtered and washed on a vacuum filter. The residue, dry weight being 335.4 g and consisting of silver chloride, lead sulphate, silica and gangue, was retained for silver recovery. The solution containing about 100 g/l of gold chloride, and small quantities of base metal chlorides was placed in a glass vessel and agitated with a propeller stirrer. Then slowly, 200 ml of a solution containing 300 g/l $Na_2S_2O_5$ was added, the amount added being calculated to precipitate approximately 80% of the gold. After 15 min. agitation, during which the temperature rose to 46°C, the solution was immediately filtered while still warm and the residue given the following sequence of washes:

1. 100 ml of solution containing: 25 g/l $NH_3$, 107 g/l $NH_4Cl$, and 100 g/l EDTA.
2. 100 ml of 10% (w/w) HCl
3. 100 ml water
4. 100 ml ethyl alcohol
5. 100 ml acetone.

The gold powder was then dried at 110°C and weighed 74.13 g. On analysis, the following content of metallic impurities was found: Ag 34–100 ppm, Cu 2 ppm, Zn 1 ppm, Fe 14 ppm, Pb 9 ppm, Na 38 ppm. A direct assay for gold content gave a value of 999,595 ppm Au. By replacing the wash of step 2 with a repulping operation, using 10% (w/w) HCl, the sodium content of the final product may be reduced to 20 ppm.

It will be seen that in the example the Cl/Au ratio was not adjusted. Subsequent experiments have shown that if this ratio is adjusted as described above, the silver content can be reduced substantially below the levels reported in the example. A range of silver levels is given as repeat tests gave different silver results.

The powder after drying is in a reactive state and may be used for the production of gold chemicals. Other uses for the powder are to make gold spheres, jewellery and other gold articles by powder metallurgy. It may also be used as a catalyst.

The powdered gold is an ideal feed material for the process in which gold powder is converted into spherical particles by mixing it with MgO and subjecting the mixture to temperature above the melting point of gold.

We claim:

1. A process for treating a gold bearing Merrill slime, comprising the steps of:

contacting said slime with a gold chloride solution with agitation, whereby dissolved gold is caused to be cemented out on said slime and base metal impurities are caused to go into solution;

separating the cemented slime from the solution;

suspending the cemented slime in water and chlorinating the suspension by passing chlorine gas through it;

separating the residual solution from the solids;

precipitating gold powder from the residual solution by the addition of less than a stoichiometric amount of a suitable reductant so that a proportion of the gold remains in the residual solution and separating, washing and drying the precipitated gold powder.

2. The process of claim 1, in which the residual solution left after separation of gold powder is used for contacting the slime.

3. The process of claim 2 in which the molar ratio of Cl/Au in the chlorinated suspension is adjusted to be about 4 before separating the solution from the cemented slime.

4. The process of claim 3 in which the molar ratio of Cl/Au is increased before precipitating gold powder from the solution.

5. The process of claim 1 in which the precipitated gold powder is washed with an aqueous solution of ammonia, ammonium chloride and EDTA after separation.

* * * * *